US008020623B2

(12) United States Patent
Parks et al.

(10) Patent No.: US 8,020,623 B2
(45) Date of Patent: Sep. 20, 2011

(54) CONTROL MODULE FOR SUBSEA EQUIPMENT

(75) Inventors: William C. Parks, Utopia, TX (US); Dana C. Beebe, Houston, TX (US); Chester W. Kronke, Houston, TX (US)

(73) Assignee: DTC International, Inc., Houston, TX (US)

( * ) Notice: Subject to any disclaimer, the term of this patent is extended or adjusted under 35 U.S.C. 154(b) by 465 days.

(21) Appl. No.: 12/189,680

(22) Filed: Aug. 11, 2008

(65) Prior Publication Data

US 2009/0038805 A1 Feb. 12, 2009

Related U.S. Application Data

(60) Provisional application No. 60/954,919, filed on Aug. 9, 2007, provisional application No. 60/955,085, filed on Aug. 10, 2007.

(51) Int. Cl.
*E21B 23/00* (2006.01)
*E21B 34/04* (2006.01)

(52) U.S. Cl. ..... 166/341; 166/339; 166/344; 166/368; 251/28; 251/30.01

(58) Field of Classification Search ..... 166/341, 166/339, 344, 381, 386, 368; 251/28, 30.01
See application file for complete search history.

(56) References Cited

U.S. PATENT DOCUMENTS 2,515,258 A * 7/1950 O'Brien et al. ..... 335/253
2,515,259 A * 7/1950 O'Brien et al. ..... 335/253
3,496,999 A 2/1970 Rowley
3,701,549 A * 10/1972 Koomey et al. ..... 285/24
3,820,600 A * 6/1974 Baugh ..... 166/338
3,839,608 A * 10/1974 De Vries ..... 200/51.07
3,840,071 A * 10/1974 Baugh et al. ..... 166/338
3,946,805 A * 3/1976 Peterman ..... 166/349
4,327,344 A * 4/1982 Luckenbach ..... 335/253
4,411,454 A * 10/1983 Nayler et al. ..... 285/26
4,460,156 A * 7/1984 Hazelrigg et al. ..... 251/149.3
4,478,292 A 10/1984 Baugh
4,488,740 A 12/1984 Baugh
(Continued)

OTHER PUBLICATIONS

International Search Report dated Jan. 14, 2009 (3 pages).

*Primary Examiner* — Thomas Beach
*Assistant Examiner* — Matthew R Buck
(74) *Attorney, Agent, or Firm* — Bracewell & Giuliani, LLP

(57) ABSTRACT

A subsea control module for providing control of subsea equipment is provided. The design allows for replacement and retrieval of a subsea control module with a single remotely operated vehicle ("ROV") deployment from a vessel. The subsea control module can provide distributed electrical and hydraulic control functions via multiple directional control valve modules, multiple pilot valve modules, and a central electronic control module. Each directional control and pilot perform a set of functions so that replacement of a single module does not require disassembly of any other components) or hydraulic connection. Similarly, each pilot valve module can include a set of pilot valves, pressure transducers, solenoids and electronic circuitry to perform a limited set of functions so that failure of a single pilot valve module does not result in failure of the entire subsea control module. The central electronic control module can provide electrical signals to each pilot valve module which can provide hydraulic signals to each directional control valve module and to off-board hydraulics through a subsea equipment receptacle mated with the subsea control module.

37 Claims, 5 Drawing Sheets

U.S. PATENT DOCUMENTS 4,489,959 A * 12/1984 Satterwhite ..... 285/18
4,548,273 A 10/1985 Leicht
4,564,068 A 1/1986 Baugh
4,607,701 A * 8/1986 Gundersen ..... 166/368
4,615,544 A 10/1986 Baugh
4,637,470 A * 1/1987 Weathers et al. ..... 166/344
4,648,629 A * 3/1987 Baugh ..... 285/26
4,649,241 A * 3/1987 Young et al. ..... 200/82 R
5,333,691 A * 8/1994 Dean et al. ..... 166/341
5,398,761 A * 3/1995 Reynolds et al. ..... 166/344
5,417,459 A * 5/1995 Gray et al. ..... 285/26
5,456,313 A * 10/1995 Hopper et al. ..... 166/97.1
6,032,742 A * 3/2000 Tomlin et al. ..... 166/345
6,068,427 A * 5/2000 Østergaard ..... 405/191
6,161,618 A * 12/2000 Parks et al. ..... 166/351
6,422,315 B1 * 7/2002 Dean ..... 166/339
6,484,806 B2 * 11/2002 Childers et al. ..... 166/351
6,622,799 B2 * 9/2003 Dean ..... 166/381
6,644,410 B1 * 11/2003 Lindsey-Curran et al. ... 166/360
6,907,932 B2 * 6/2005 Reimert ..... 166/341
6,938,695 B2 * 9/2005 Williams ..... 166/341
7,172,447 B2 * 2/2007 Allensworth et al. ..... 439/271
7,216,714 B2 * 5/2007 Reynolds ..... 166/338
7,216,715 B2 * 5/2007 Reynolds ..... 166/339
7,222,674 B2 * 5/2007 Reynolds ..... 166/341
7,487,836 B2 * 2/2009 Boyce et al. ..... 166/340
7,690,433 B2 * 4/2010 Reynolds ..... 166/338
7,757,772 B2 * 7/2010 Donohue et al. ..... 166/344
2009/0294129 A1 * 12/2009 Judge et al. ..... 166/341

* cited by examiner

CONTROL MODULE FOR SUBSEA EQUIPMENT

RELATED APPLICATIONS

This patent application is a non-provisional application which claims priority to and the benefit of U.S. Patent Application No. 60/954,919, by Parks et al, titled "Control Module for Subsea Equipment," filed on Aug. 9, 2007, and U.S. Patent Application No. 60/955,085, by Parks et al, titled "Control System for Blowout Preventer Stack," filed on Aug. 10, 2007, both incorporated by reference herein in their entirety.

BACKGROUND OF THE INVENTION

1. Field of the Invention

This invention relates in general to hydraulically controlling valves and connectors of subsea equipment, such as a blowout preventer and lower marine riser package, and in particular to a control module containing electronics and hydraulic control valves.

2. Description of Related Art

Subsea Control Modules (SCMs) are commonly used to provide well control functions during the production phase of subsea oil and gas production. Typical well control functions and monitoring provided by the SCM are as follows: 1) Actuation of fail-safe return production tree actuators and downhole safety valves; 2) Actuation of flow control choke valves, shut-off valves, etc.; 3) Actuation of manifold diverter valves, shut-off valves, etc.; 4) Actuation of chemical injection valves; 5) Actuation and monitoring of Surface Controlled Reservoir Analysis and Monitoring Systems (SCRAMS) sliding sleeve, choke valves; 6) Monitoring of downhole pressure, temperature and flowrates; 7) Monitoring of sand probes, production tree and manifold pressures, temperatures, and choke positions.

The close proximity of the typical SCM to the subsea production tree, coupled with its electro-hydraulic design allows for quick response times of tree valve actuations. The typical SCM receives electrical power, communication signals and hydraulic power supplies from surface control equipment. The subsea control module and production tree are generally located in a remote location relative to the surface control equipment. Redundant supplies of communication signals, electrical, and hydraulic power are transmitted through umbilical hoses and cables of any length, linking surface equipment to subsea equipment. Electronics equipment located inside the SCM conditions electrical power, processes communications signals, transmits status, and distributes power to devices such as, solenoid piloting valves, pressure transducers, and temperature transducers.

Low flowrate solenoid piloting valves are typically used to pilot high flowrate control valves. These control valves transmit hydraulic power to end devices such as subsea production tree valve actuators, choke valves and downhole safety valves. Pressure transducers located on the output circuit of the control valves read the status condition of control valves and their end devices. Auxiliary equipment inside the typical SCM consist of hydraulic accumulators for hydraulic power storage, hydraulic filters for the reduction of fluid particulates, electronics vessels, and a pressure/temperature compensation system.

An SCM is typically provided with a latching mechanism that extends through the body of the SCM and that has retractable and extendable dogs or cams thereon to engage a mating receptacle in a base plate.

Many previous devices have used an oil-filled chamber to compensate for hydrostatic pressure increase outside of the device during use to keep seawater away from electronics and cable assemblies. More progressive SCMs, such as, for example, those described in U.S. Pat. No. 6,161,618, by Parks et al. incorporated by reference in its entirety, provides a serially modular design which includes a dry electronics chamber located under a pressure dome.

Recognized by the inventors, however, is that further modularization can reduce cost of individual SCMs, especially where a customer only requires a partial package, can allow for additional redundancy, can enhance functionality and the number of functions a module is capable of performing, can enhance survivability during deployment, operation, and retrieval, and can reduce maintenance repair time and costs, along with many other benefits.

SUMMARY OF THE INVENTION

In view of the foregoing, embodiments of the present invention advantageously provide a base subsea control module applicable for use in both the drilling and production phase, or in other applications, including application as a front end of a blow-out preventer (BOP) control system. Embodiments of the present invention provide a subsea control module which is modularized beyond that of other prior devices to facilitate tailoring the device to meet specific customer needs, to provide for additional redundancy, to enhance functionality and the number of functions a module is capable of performing, to enhance survivability during deployment, operation, and retrieval, and to reduce maintenance repair time and costs, along with many other benefits. The design can allow for replacement and retrieval of a faulty subsea control module with a single remotely operated vehicle ("ROV") deployment from a vessel.

More particularly, an embodiment of the present invention advantageously provides a subsea control module including a module body having an axial bore extending therethrough, a proximal or upper body end portion, a distal or lower body end portion, and a medial body portion extending therebetween. The medial body portion of the module body includes an elongate annular recess extending radially into the medial body portion to define a valve module receptacle. A plurality of, e.g., trapezoidal shaped valve modules are each replaceably positioned radially along an inner surface of the valve module receptacle, approximately flush with the proximal and the distal body end portions, and are adapted to communicate hydraulic fluid with a separate one of a plurality of spaced apart apertures in the medial body portion of the module body. Each valve module can include a valve module housing containing at least one, but typically a pair of directional control valves, oriented axially within the respective valve module housing along a same longitudinal axis to thereby reduce a lateral physical signature of the respective valve housing. The subsea control module can also include a plurality of containers positioned to contain distributed electrical component defining a plurality of pilot valve modules. Each pilot valve module can include a pilot valve housing containing a plurality of pilot valves, a plurality of pressure transducers, and a plurality of solenoids.

The subsea control module can also include a central core positioned within the axial bore of the module body and can include a proximal end portion, a distal end portion, and a medial portion having an external surface spaced radially inward from the axial bore of the module body to form an annular cavity therebetween, to contain electronic circuitry. Further, the proximal end and the distal end portions of the central core can each have diameters greater than that of the medial portion of the central core. Additionally, the central core can include a cylindrical cover extending around the medial body portion of the central core, around at least a portion of an exterior surface of the proximal end portion of the central core, and around at least a portion of an exterior surface of the distal end portion of the central core. The cylindrical cover can be positioned within the axial bore of the module body and can have an inner surface spaced radially apart from the exterior surface of the medial portion of the central core. As such, the cylindrical cover can seal the annular cavity to form a housing to contain the electronic circuitry, which can include an electronic control module positioned to communicate with each of the plurality of pilot valve modules, and electrical circuitry in a subsea equipment receptacle, which, in turn, can provide a communication link with a surface computer.

According to a preferred configuration, the annular cavity is characterized by being a dry, air-tight cavity formed between the module body and the central core, is purged of air and containing nitrogen at a pressure of at or near approximately atmospheric pressure, and each pilot valve housing can contain a dry, air-tight cavity, purged of air and containing nitrogen at a pressure of at or near approximately atmospheric pressure. This advantageously enhances maintainability of the components inside each cavity.

The proximal body end portion of the module body can include a plurality of passageways formed in the proximal body end portion, which are collectively positioned to communicate hydraulic fluid between the plurality of pilot valve modules and the plurality of valve modules to define a plurality of mating passageways. Similarly, the proximal end portion of the central core can include a plurality of passageways formed in the proximal end portion, which contain or house an electrical penetrator sealingly positioned to communicate control signals between the electronic control module and a separate one of the plurality of pilot valve modules. The subsea control module can further include a seal plate positioned between each of the plurality of pilot valve modules and the plurality of mating passageways of the module body and the plurality of passageways of the central core to seal an interface between the plurality of pilot valve modules and the respective passageways.

The subsea control module can further include a plurality of hydraulic couplings extending distally from the distal body end portion of the module body and a plurality of electrical couplings similarly extending distally from the distal end portion of the central core. A cylindrical outer protective cover extending around an exterior of the medial body portion of the module body and around an exterior of the distal end portion of the module body, also extends axially beyond a distal end surface of the distal body end portion of the module body, to provide damage protection to the plurality of couplings when coupling the subsea control module to a subsea equipment receptacle.

Various other features according to embodiment of the present invention are also provided to enhance functionality and the number of functions a module is capable of performing, to enhance survivability during deployment, operation, and retrieval, and to reduce maintenance repair time and costs, along with many other benefits.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

FIGS. 1-5 illustrate a subsea control module 11 that is modularized beyond that of other prior devices to facilitate tailoring the device to meet specific customer needs, to provide for additional redundancy, to enhance functionality and the number of functions a module is capable of performing, to enhance survivability during deployment, operation, and retrieval, and to reduce maintenance repair time and costs, along with many other benefits including allowing for replacement and retrieval of a faulty subsea control module with a single remotely operated vehicle ("ROV") deployment from a vessel (not shown).

Figure 1:
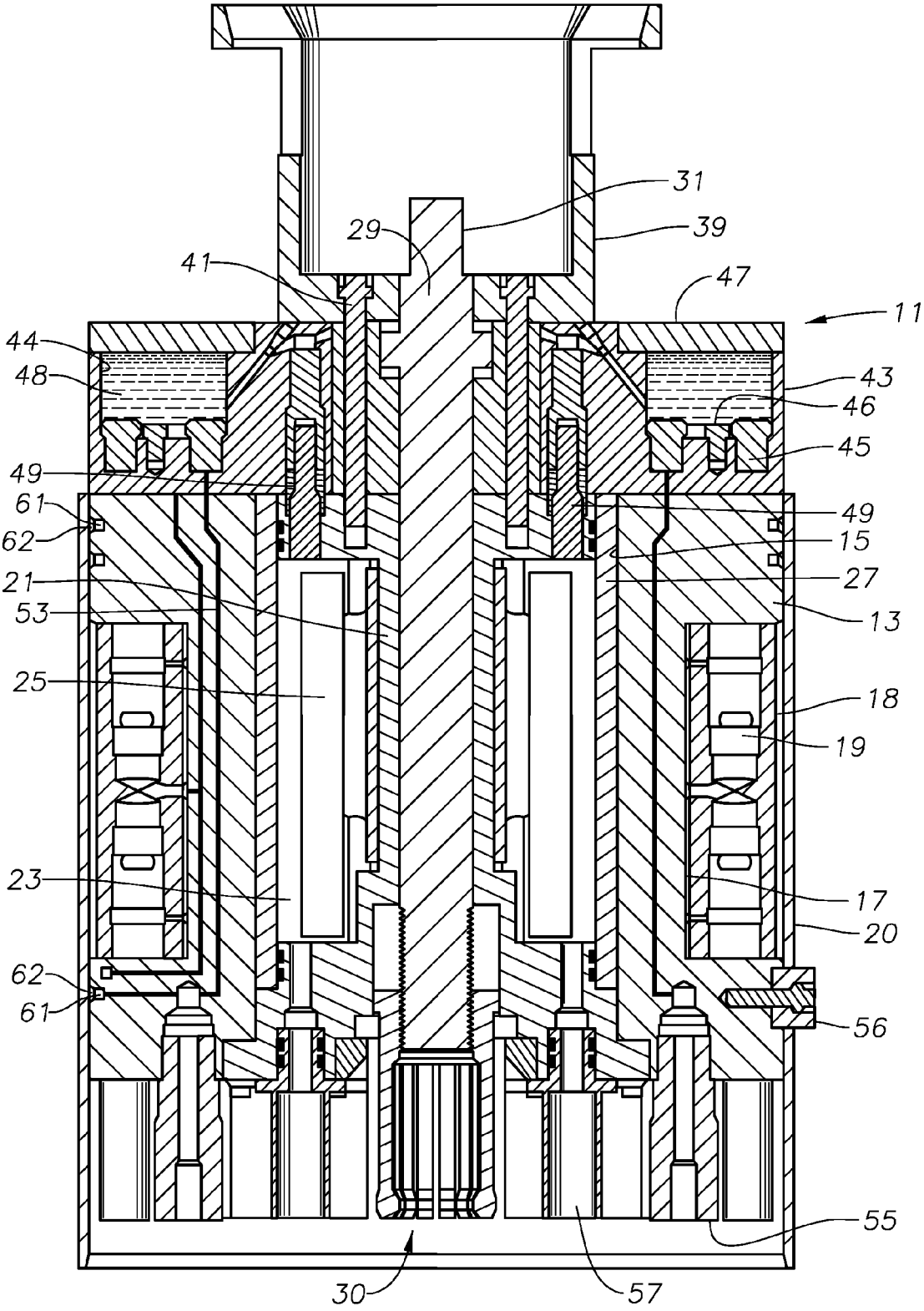
FIG. 1 is a vertical sectional view illustrating a control module constructed according to an embodiment of the present invention.
Figure 2:
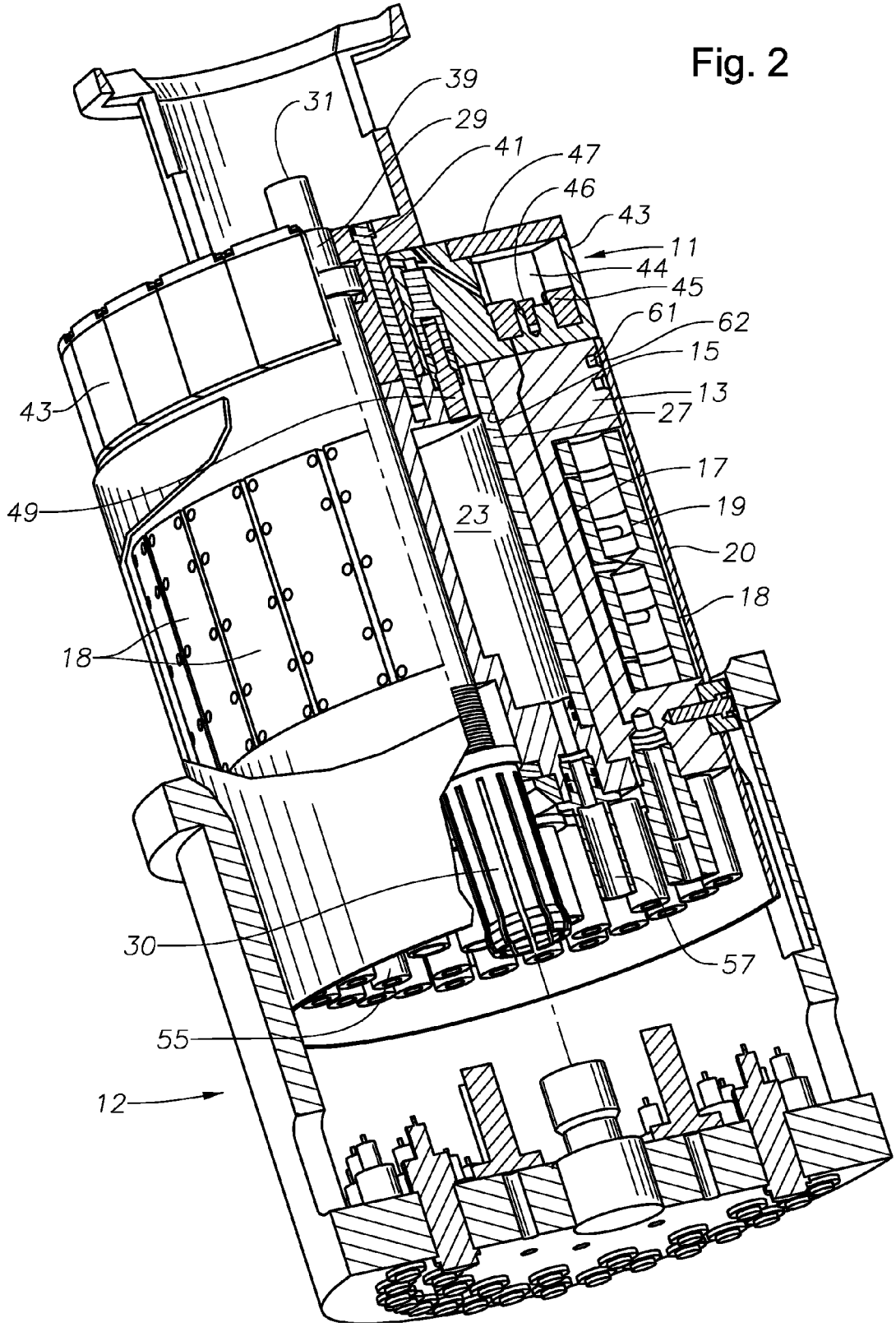
FIG. 2 is a perspective and sectional view of the control module of FIG. 1 in association with the subsea equipment receptacle, according to an embodiment of the present invention.
Figure 3:
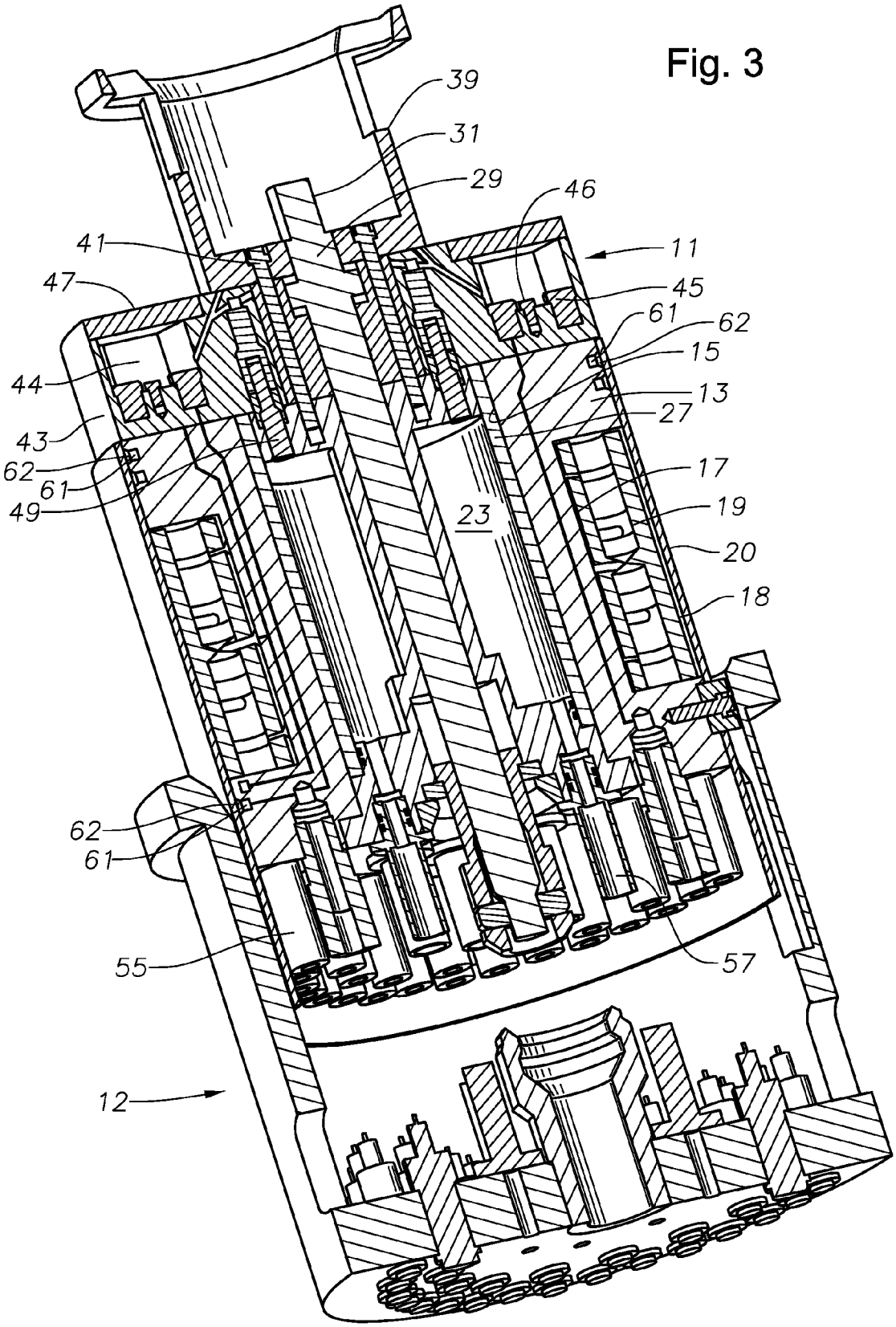
FIG. 3 is a perspective and sectional view of the control module similar to that of FIG. 1 in association with the subsea equipment receptacle, but with an alternative subsea equipment receptacle latching mechanism, according to an embodiment of the present invention.

Referring to FIGS. 1, 2 and 3, a subsea control module 11, according to a preferred configuration, is employed to connect into subsea equipment, such as a subsea production tree, blowout preventer, lower marine riser package, or other subsea remotely operated equipment (not shown), through use of a subsea equipment receptacle 12. Module 11 has a tubular body 13 with an axial bore 15. An annular recess 17 extends around the exterior of body 13, giving body 13 a spool-shaped configuration. At least one, but up to 16 directional control valve modules 18 each including, for example, a pair of directional control valves 19 are mounted in recess 17. A cylindrical cover or sleeve 20 extends around body 13, closing the outer side of cavity 17.

A central core 21 is mounted inside body 13. Core 21 has a cylindrical cover 27 spaced radially inward from bore 15 of body 13, creating an annular cavity 23. Electronic circuitry 25 is located within annular cavity 23. In one embodiment, annular cavity 23 is purged of air, filled with nitrogen, and remains at or near atmospheric pressure while subsea. With this embodiment, there is no need to equalize the pressure of the atmosphere in the electronics cavity 23 with that of the sea. Alternately, annular cavity 23 could be filled with a dielectric fluid and pressure compensated.

A connecting rod 29 extends through a central passage in core 21 for connecting subsea control module 11 to a receptacle 12 mounted on a piece of subsea equipment. Rod 29 has a drive head 31 on its upper end for access by a tool of a ROV (not shown), and a latch mechanism 30 adapted to engage a mandrel (not shown) in the subsea electrical equipment receptacle 12. FIG. 2 illustrates the latching mechanism in the form of a collet 30 threadingly interfaced with the connecting rod 29. When rod 29 rotates, the collet 30 clamps around a mandrel in the receptacle 12. Continued rotation will draw the module 11 into the receptacle 12. Reverse action will disengage the module 11 from the receptacle 12. FIG. 3 illustrates the latching mechanism 30 in the form of a set of dogs, which engage a female latching component in the receptacle 12. Regardless of the configuration of the subsea control module latching mechanism, engagement and disengagement procedures are substantially the same.

Referring again to FIGS. 1, 2 and 3, an ROV interface 39 mounts to central core 21 by a plurality of fasteners 41. The illustrated ROV interface 39 is a cup shaped member to which an ROV secures to while rotating drive head 31. Other interfaces are, of course, within the scope of the present invention.

Figure 4:
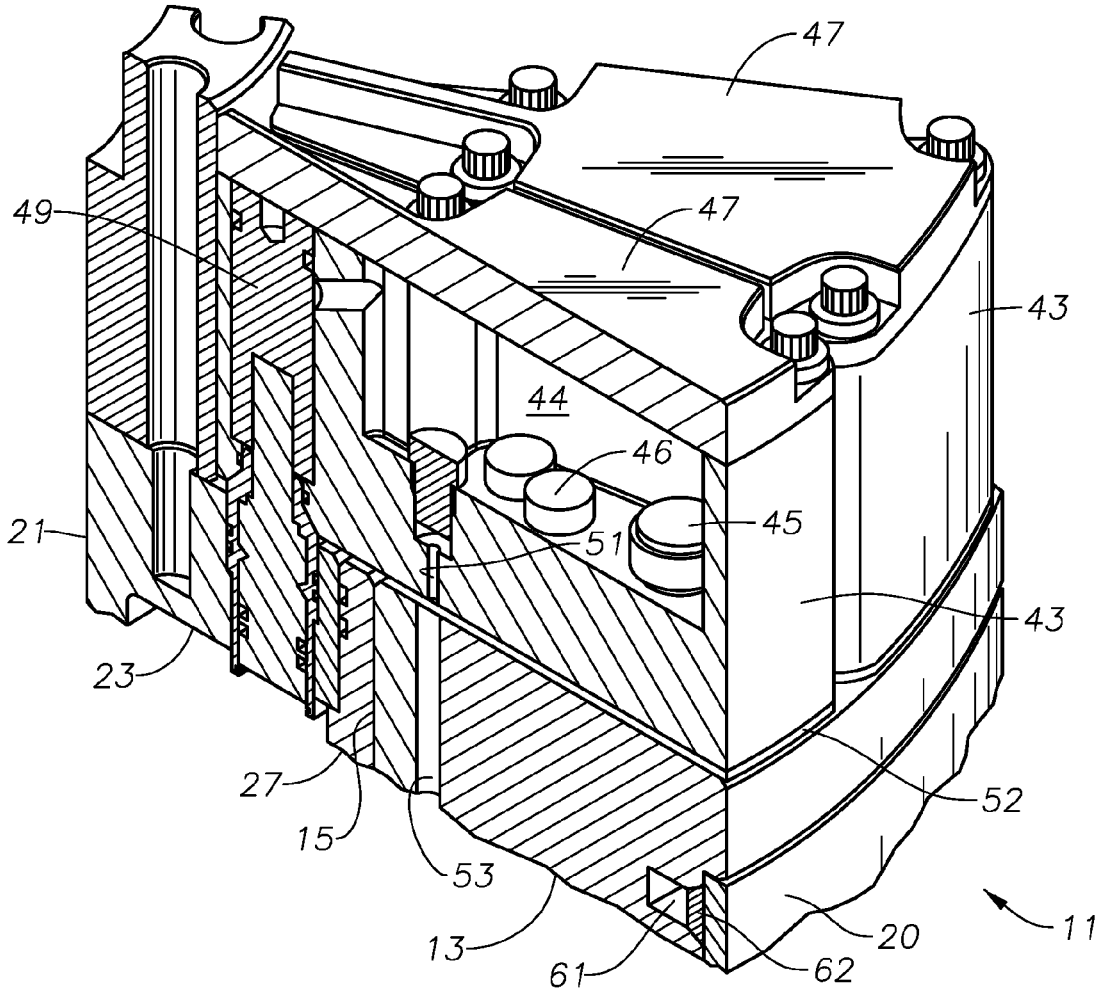
FIG. 4 is a perspective and sectional view of a pilot valve housing for the control module of FIG. 1, according to an embodiment of the present invention.
Figure 5:
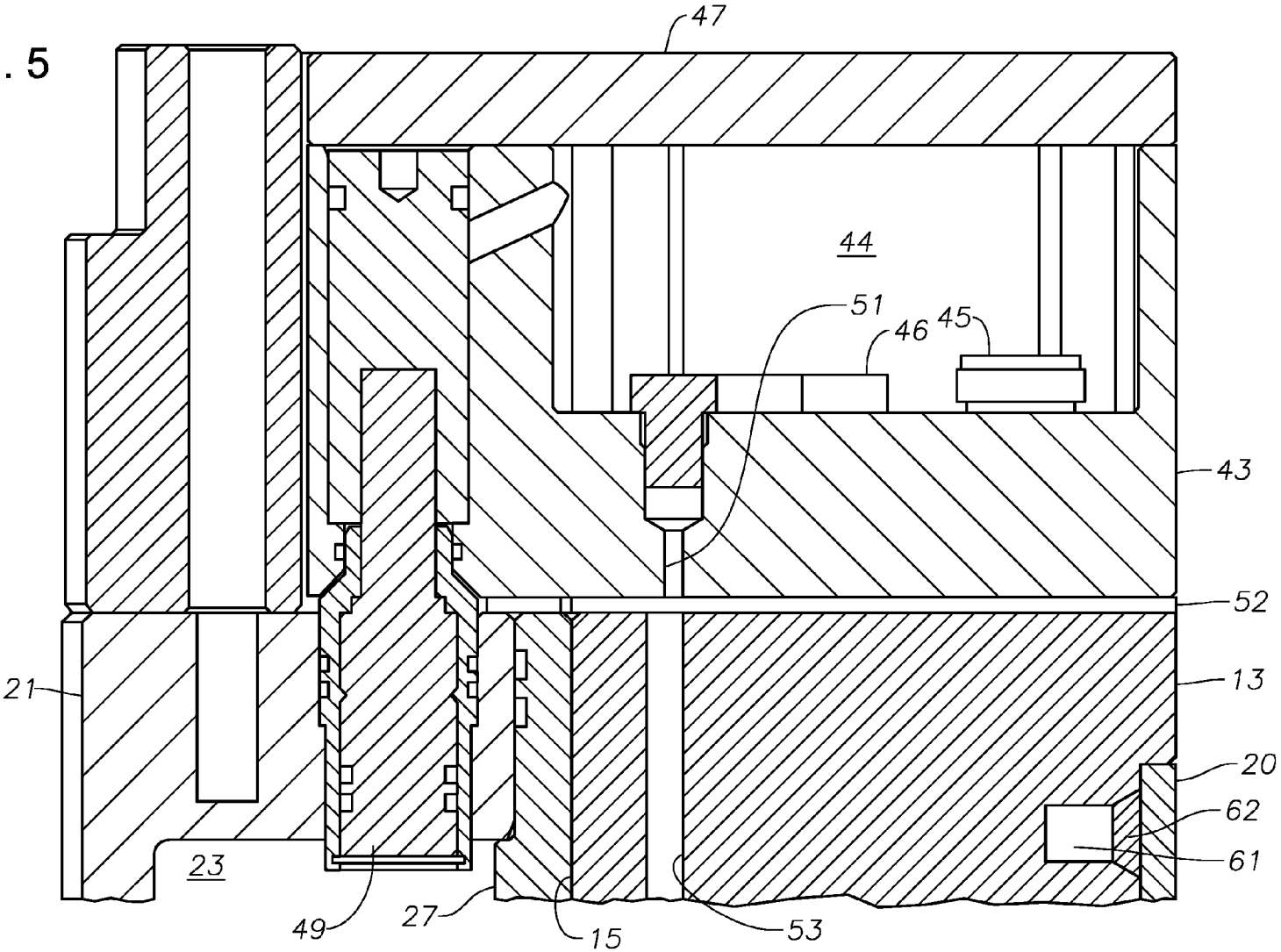
FIG. 5 is a sectional side view of the pilot valve housing shown in FIG. 4, according to an embodiment of the present invention.

As perhaps best shown in FIG. 4, in this illustrated configuration, a plurality of pilot valve modules 43 are mounted on the upper (proximal) end of body 13. Each pilot valve module 43 is a pie-or wedge-shaped segment having a sealed chamber 44. Other shapes are, of course, within the scope of the present invention. There are, however, benefits to the wedge-shape, as it has been found easier to maximize the number of pilot valve modules 43 capable of being positioned atop the proximal end of body 13. One or more pilot valves 45, one or more pressure transducers 46, and associated electronic circuitry 48 (shown diagrammatically in FIG. 1) are mounted within chamber 44 of each pilot valve module 43. Each pilot valve 45 includes a solenoid that when receiving an electrical signal, will open or close a supply of hydraulic fluid pressure to another element, such as one of the directional control valves 19 or another valve of the subsea equipment. Each pilot valve module 43 has a cap 47 that is secured by fasteners to the upper end. Chamber 44 within each pilot valve module 43 is sealed by cap 47 and isolated from chambers of adjacent pilot valve housings 43. Chamber 44 remains at or near atmospheric pressure while subsea, e.g., purged of air and filled with nitrogen, or alternately, it could be filled with a dielectric fluid and pressure compensated.

At electrical penetrator 49 extends sealingly into each pilot valve module 43. The lower end of each penetrator 49 is in communication with annular electronics cavity 23 (FIG. 1) for receiving electrical connections leading to electronic circuitry 48, pilot valves 45 and transducers 46. Also, each pilot valve module 43 has a plurality of hydraulic fluid ports/passageways 51 (only one shown), each extending from a pilot valve 45, a pressure transducer 46 or other hydraulic porting to mating ports/passageways 53 (only one shown) within module body 13. The pressure transducers 46 measure pressures in the hydraulic porting. One or more of the ports/passageways 53 serves as an output port/passageway and may lead to one of the directional control valves 19 or to a hydraulic coupling 55 on the lower (distal) end of body 13 of module 11. Another of the ports/passageways 53 supplies hydraulic fluid pressure from one of the hydraulic couplings 55 to one or more of the pilot valves 45. A plurality of at least partially annular recesses extending radially into the proximal body end portion and/or distal end portion of the body 13 to define a plurality of ring headers 61 distribute to or collect hydraulic fluid from at least one of the plurality of ports/passageways 53, sealed with an at least partial outer ring 62. A seal plate or other sealing mechanism 52 seals the interface between the various ports 51 and 53.

The electronic circuitry 48 within each chamber 44 of each separate pilot valve module 43 monitors and controls pilot valves 45 and pressure transducers 46 of the respective pilot valve module 43. Electronics circuitry 48 receives power from and communicates with electronics circuitry 25 in cavity 23.

Referring again to FIG. 1, hydraulic couplings 55 protrude from the lower end of module body 13. Sleeve 20 preferably extends downward past body 13 and encircles the assembly of couplings 55 to provide protection of the couplings 55 during at least initial engagement of the subsea control module 11 with the subsea equipment receptacle 12. Further, at least one alignment key 56 interfaces with a corresponding guide (not shown) within the subsea equipment receptacle 12 to further aid in alignment of the couplings 55 with couplings of the subsea equipment receptacle 12.

The hydraulic couplings 55 register with hydraulic ports/passageways 53 (see, e.g. FIG. 1) leading to or from directional control valves 19, or register with ports/passageways 53 (see, e.g. FIG. 5) leading to and from pilot valve module 43. Hydraulic couplings 55 will stab into mating engagement with couplings in the receptacle 12 for receiving hydraulic fluid pressure from a source and for transmitting hydraulic fluid pressure to the valves, connectors, actuators or other elements of the subsea equipment.

A plurality of electrical couplings 57 are similarly mounted to, and protrude, from the lower (distal) end of central core 21 of subsea control module 11. Each electrical coupling 57 is connected to one or more wires leading to the electronic circuitry 25 for supplying power and communication. Fiber optic couplings may also be employed. Additional electrical couplings are available for powering and communicating with externally mounted instruments or devices.

The electronic circuitry contained in the electronic control module 25 shown schematically in FIGS. 1-3, which, as known and understood by those skilled in the art, can include a controller, memory coupled to the controller, and program code adapted to communicate with a surface computer positioned on a surface platform, through an umbilical cord connected to a subsea production tree, a lower marine riser package, or other subsea equipment (not shown).

Subsea control module 11 is small and lightweight enough to be installed subsea by the use of a remotely operated vehicle ("ROV"). The ROV stabs it into mating receptacle 12, then rotates rod 31. When fully connected, hydraulic fluid pressure is supplied to various hydraulic couplings 55 and electrical power and communication signals are supplied to electronic circuitry 25 and 48, through electrical couplings 57.

To perform a particular function, an electrical or fiber optic signal will be sent from a remote location, such as a vessel at the surface, for example, via the umbilical cord associated with the subsea equipment (not shown). This signal causes electronic circuitry 25 to provide power to one of the pilot actuated valves 45, which in turn supplies hydraulic pressure to a hydraulic actuated device of the subsea equipment. In some instances, the pilot valves 45 will supply hydraulic pressure to one of the directional control valves 19, which in turn supplies a larger volume of hydraulic pressure for causing larger users of hydraulic fluid pressure, such as annular preventers, and large valve actuators. Optionally, some of the pilot valves 45 may supply hydraulic pressure directly to a hydraulic device rather than via one of the directional control valves 19.

Various embodiments of the present invention have several advantages. For example, embodiments of the present invention provide a modular design which concentrates actuatable hydraulic components in the removable subsea control module 11, in contrast to having actuatable components in a mating subsea equipment receptacle 12 to thereby allow efficient maintenance—i.e., maintenance can be accomplished in a single ROV deployment by replacing the subsea control module having a malfunctioning component. That is, a single ROV deployment can provide removal of a faulty subsea control module 11, replacement of a new subsea control module 11, and can include ancillary maintenance operations.

Embodiments of the present invention optimize maintainability of individual subsea control modules 11 by distributing electrical and electrically actuated components most likely to fail, e.g., pilot valves 45, solenoids, and pressure sensors 46, across multiple miniature, e.g., one-atmosphere pilot valves modules 43, which allows easy line replacement. Such modules 43, according to an embodiment of the present invention, can be oriented in a wedge shaped design and can readily contain up to eight solenoids, eight correlated pilot valves, and up to ten pressure transducers. Advantageously, such configuration can allow for up to four functions per module 43, and can allow for closed-circuit (return-to-surface) hydraulic function, in addition to open circuit (vent-to-sea) hydraulic function.

Embodiments of the present invention also optimize maintainability of the individual subsea control modules 11 by distributing hydraulic directional control valves 19 also across multiple miniature, e.g., directional control valves modules 18, which allow for easy "off-line" replacement. Further, advantageously, by orienting the directional control valves 19 longitudinally within each module 18, embodiments of the present invention have increased the number of directional control valves 19 to thirty-two, having, e.g., two per module 18, and preferable with sixteen modules 18 oriented radially around an outer portion of a module body 13 to allow for the easy removal/repair/replacement.

Embodiments of the present invention include a module body 13 that contains no hydraulic tubings or fittings, but rather, provides a manifold design that reduces likelihood of leakage. The hydraulic passageways 53 can communicate with one or more ring headers 61 embedded along outer surfaces of the module body 13. The ring headers 61 can advantageously function to distribute and/or collect hydraulic fluid.

According to embodiments of the present invention, advantageously, the module body 13 can include a relatively large central bore 15, which accommodates central core 21, with sealed cover 27 to provide an, e.g., one atmosphere, annular chamber or cavity 23 containing a central electronic control module 25, which can electrically communicate with each pilot valves module 43 and with electronics or other communication media of the mating subsea equipment receptacle 12. By providing such modular design with central control, problems with the subsea control module 11 can be easily identified, allowing less time spent on maintenance, and allowing for additional monitoring and emergency control.

Embodiments of the present invention also advantageously provide an extended protective cover or sleeve 20, which can advantageously extend beyond the module body 13 to protect individual hydraulic couplings 55 and electrical couplings 57 which couple or mate with compatible couplings located in the subsea equipment receptacle 12. The extension portion of the protective cover or sleeve 20 prevents damage during initial alignment during engagement of the subsea control module 11 with the subsea equipment receptacle 12. Further, one or more alignment keys 56 can advantageously enhance initial alignment with the subsea equipment receptacle 12, preventing risk of damage during mating of the subsea control module 11 with the subsea equipment receptacle 12.

Various other functions according to one or more embodiments of the present invention, provide a completely ROV retrievable subsea control module 11, which can provide up to thirty-two or more solenoids for drilling operations, up to sixty-four or more solenoids for production operations, up to ninety pressure transducers, up to thirty-two directional control valves, pilot filters, multiple supply manifolds, multiple hydraulic and/or electrical couplings, and electronics modules, up to eight electrical wet-mate connectors, a central collett latch, humidity detection in electrical chambers, and redundant power, communications, and controller; which does not require or include hydraulic tubing or fittings; and which allows for all repairs to be completed "off-line."

This patent application is related to U.S. Patent Application No. 60/954,919, by Parks et al, titled "Control Module for Subsea Equipment," filed on Aug. 9, 2007, U.S. patent application Ser. No. _____, by Parks et al, titled "Control System for Blowout Preventer Stack," filed on Aug. 11, 2008, and U.S. Patent Application No. 60/955,085, by Parks et al, titled "Control System for Blowout Preventer Stack," filed on Aug. 10, 2007, each incorporated by reference herein in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. A subsea control module to connect to a piece of subsea equipment, comprising:

a subsea control module body having an axial bore extending therethrough;

a central core positioned within the axial bore of the module body and including a proximal end portion, a distal end portion, and a medial portion, the medial portion having an external surface spaced radially inward from the axial bore of the module body to form an annular cavity therebetween to contain electronic circuitry; and an electronic control module positioned within the annular cavity to receive electrical power from a piece of subsea equipment.

2. The subsea control module as defined in claim 1, wherein the proximal and the distal end portions of the central core each have diameters substantially greater than a diameter of the medial portion of the central core; and wherein the central core includes a cylindrical cover extending around the medial body portion of the central core, at least a portion of an exterior surface of the proximal end portion of the central core, and at least a portion of an exterior surface of the distal end portion of the central core, the cylindrical cover positioned within the axial bore of the module body and having an inner surface spaced substantially radially apart from the exterior surface of the medial portion of the central core.

3. The subsea control module as defined in claim 1, wherein the annular cavity is characterized by being a dry, air-tight cavity, purged of air and containing nitrogen at a pressure of at or near approximately atmospheric pressure.

4. The subsea control module as defined in claim 1, wherein the annular cavity is characterized by being a fluid filled cavity and pressure compensated.

5. The subsea control module as defined in claim 1, wherein the central core includes a substantially centrally located axial bore extending therethrough, the subsea module further comprising a connecting rod extending through the axial bore of the central core to connect the subsea control module to a subsea equipment receptacle, the connecting rod including a connection interface adapted to engage a mandrel in the subsea equipment receptacle responsive to rotation of the connecting rod.

6. The subsea control module as defined in claim 1, further comprising a remotely operated vehicle ("ROV") interface connected to the proximal end portion of the central core to allow manipulation of the subsea control module by a remotely operated vehicle, the remotely operated vehicle interface including a substantially cylindrical main body, a substantially open proximal end portion, and a distal end portion having a primary aperture for receiving a proximal end portion of the connecting rod and a plurality of secondary apertures for receiving a corresponding plurality of fasteners to connect the interface to the proximal end portion of the central core.

7. The subsea control module as defined in claim 1, wherein the module body includes a proximal body end portion, a distal body end portion, and a medial body portion extending therebetween, the medial body portion of the module body including an elongate annular recess extending radially into the medial body portion to define a valve module receptacle, the subsea control module further comprising:

a plurality of directional control valve modules each positioned within the valve module receptacle, each directional control valve module positioned radially along an inner surface of the valve module receptacle and adapted to communicate hydraulic fluid with a separate one of a plurality of spaced apart apertures, each directional control valve module including a valve module housing containing at least one directional control valve.

8. The subsea control module as defined in claim 7, wherein each directional control valve module contains at least one directional control valve oriented axially within the respective valve module housing along a same longitudinal axis to thereby reduce a lateral physical signature of the respective valve housing.

9. The subsea control module as defined in claim 1, wherein the module body includes a proximal body end portion, a distal body end portion, and a medial body portion extending therebetween, the medial body portion of the module body including an elongate annular recess extending radially into the medial body portion to define a valve module receptacle, the subsea control module further comprising:

a plurality of modules comprising at least one directional control valve module including a valve module housing containing at least one directional control valve, and one or more of the following: filter or accumulator modules, each module positioned within the valve module receptacle, radially along an inner surface of the valve module receptacle and in fluid communication with a separate one of a plurality of spaced apart apertures.

10. The subsea control module as defined in claim 9, wherein the medial body portion of the module body includes a plurality of passageways formed in the medial body portion to communicate hydraulic fluid; and wherein the plurality of spaced apart apertures are each positioned radially along an inner surface of the valve module receptacle and each in fluid communication with at least one of the plurality of passageways in the medial body portion to communicate hydraulic fluid between a separate one of the plurality of directional control valve modules and at least one of the plurality of passageways.

11. The subsea control module as defined in claim 1, wherein the module body includes a proximal body end portion, a distal body end portion, and a medial body portion extending therebetween;

wherein the proximal body end portion of the module body includes a plurality of passageways formed in the proximal body end portion to communicate hydraulic fluid, and a plurality of at least partially annular recesses extending radially into the proximal body end portion from an exterior surface to define a plurality of proximal ring headers each positioned to distribute to or collect hydraulic fluid from at least one of the plurality of passageways formed in the proximal body end portion of the module body; and wherein the distal body end portion of the module body includes a plurality of passageways formed in the distal end portion to communicate hydraulic fluid, and at least one partially annular recess extending radially into the distal body end portion from an exterior surface to define at least one distal ring header positioned to distribute to or collect hydraulic fluid from at least one of the passageways formed in the distal body end portion of the module body.

12. The subsea control module as defined in claim 1, wherein the module body includes a proximal body end portion, a distal body end portion, and a medial body portion extending therebetween;

wherein the distal body end portion of the module body includes a plurality of passageways formed in the distal body end portion and positioned to communicate hydraulic fluid between the subsea control module and a subsea equipment receptacle; and wherein the distal body end portion of the central core includes at least one passageway formed in the distal body portion and positioned to communicate power and control signals between the electronic control module and the subsea equipment receptacle.

13. The subsea control module as defined in claim 1, wherein the module body includes a proximal body end portion, a distal body end portion, and a medial body portion extending therebetween, and wherein the subsea control module further comprises:

a plurality of hydraulic couplings extending distally from the distal body end portion of the module body; and a plurality of signal communication couplings comprising electrical couplings, fiber-optic couplings, or a combination thereof, extending distally from the distal end portion of the central core.

14. The subsea control module as defined in claim 13, further comprising:

a cylindrical outer cover extending around an exterior of the medial body portion of the module body and around an exterior of the distal body end portion of the module body, and extending axially beyond a distal end surface of the distal body end portion of the module body to provide damage protection to the plurality of hydraulic couplings when coupling the subsea control module to a subsea equipment receptacle.

15. The subsea control module as defined in claim 14, further comprising:

an alignment key extending radially beyond an outer surface of the cylindrical outer cover adjacent to distal body end portion of the module body and positioned to interface with a corresponding groove positioned along an inner wall of the subsea equipment receptacle to enhance alignment of the plurality of hydraulic couplings and the plurality of electrical couplings of the subsea module with a corresponding plurality of hydraulic and a corresponding plurality of electrical couplings positioned within the subsea equipment receptacle.

16. The subsea control module as defined in claim 1, further comprising:

a plurality of detachable containers positioned to contain distributed electrical component defining a plurality of pilot valve modules each including a pilot valve housing, each pilot valve housing containing a plurality of pilot valves, a plurality of pressure transducers, and a plurality of solenoids, and electronic circuitry.

17. The subsea control module as defined in claim 16, wherein each pilot valve housing contains a dry, air-tight cavity, purged of air and containing nitrogen at a pressure of at or near approximately atmospheric pressure.

18. The subsea control module as defined in claim 16. wherein each pilot valve housing is characterized by being a fluid filled cavity and pressure compensated.

19. The subsea control module as defined in claim 16, wherein the module body includes a proximal body end portion, a distal body end portion, and a medial body portion extending therebetween;

wherein the proximal body end portion of the module body includes a plurality of passageways formed in the proximal body end portion and collectively positioned to communicate hydraulic fluid with the plurality of pilot valve modules; and wherein the proximal end portion of the central core includes a plurality of passageways formed in the proximal end portion, each containing an electrical penetrator positioned to communicate power and control signals between the electronic control module and a separate one of the plurality of pilot valve modules.

20. The subsea control module as defined in claim 16, wherein the module body includes a proximal body end portion, a distal body end portion, and a medial body portion extending therebetween;

wherein the proximal body end portion of the module body includes a plurality of passageways formed in the proximal body end portion and collectively positioned to communicate hydraulic fluid with the plurality of pilot valve modules; and wherein the subsea control module further comprises a seal plate positioned between each of the plurality of pilot valve modules and the plurality of mating passageways to seal an interface between the plurality of pilot valve modules and a plurality of mating passageways.

21. The subsea control module as defined in claim 1, wherein the electronic control module is positioned within the annular cavity between the medial portion of the central core and the axial bore of the module body, wherein the electronic control module includes a controller, memory coupled to the controller, and program code adapted to communicate with a surface computer positioned on a surface platform, through an umbilical cord connected to a lower marine riser package.

22. The subsea control module as defined in claim 21, further comprising:

a plurality of containers positioned to contain distributed electrical component defining a plurality of pilot valve modules each including a pilot valve housing, each pilot valve housing containing a plurality of pilot valves, a plurality of pressure transducers, and a plurality of solenoids; and wherein the electronic control module is in communication with each of the plurality of pressure transducers.

23. A subsea control module to connect to a piece of subsea equipment, comprising:

a subsea control module body having an axial bore extending therethrough, the module body includes a proximal body end portion, a distal body end portion, and a medial body portion extending therebetween, the medial body portion of the module body including an elongate annular recess extending radially into the medial body portion to define a valve module receptacle;

a plurality of directional control valve modules each replaceably positioned within the valve module receptacle, each valve module positioned radially along an inner surface of the valve module receptacle and adapted to communicate hydraulic fluid with a separate one of a plurality of spaced apart apertures in the medial body portion of the module body, each control valve module including a valve module housing containing at least one control valve.

24. The subsea control module as defined in claim 23, wherein each control valve module contains at least one directional control valve oriented axially within the respective valve module housing along a same longitudinal axis to thereby reduce a lateral physical signature of the respective valve housing.

25. The subsea control module as defined in claim 24, further comprising a filter module, accumulator module, or other control module replaceably positioned within the valve module receptacle.

26. The subsea control module as defined in claim 24, wherein the medial body portion of the module body includes a plurality of passageways formed in the medial body portion to communicate hydraulic fluid;

wherein the plurality of spaced apart apertures are each positioned radially along an inner surface of the valve module receptacle and each in communication with at least one of the plurality of passageways in the medial body portion to communicate hydraulic fluid between a separate one of the plurality of control valve modules and at least one of the plurality of passageways;

wherein the proximal body end portion of the module body includes a plurality of passageways formed in the proximal body end portion to communicate hydraulic fluid, and a plurality of at least partially annular recesses extending radially into the proximal body end portion from an exterior surface to define a plurality of proximal ring headers each positioned to distribute to or collect hydraulic fluid from at least one of the plurality of passageways formed in the proximal body end portion of the module body; and wherein the distal body end portion of the module body includes a plurality of passageways formed in the distal end portion to communicate hydraulic fluid, and at least one at least partially annular recess extending radially into the distal body end portion from an exterior surface to define at least one distal ring header positioned to distribute to or collect hydraulic fluid from at least one of the passageways formed in the distal body end portion of the module body.

27. The subsea control module as defined in claim 23, further comprising:

a central core positioned within the axial bore of the module body and including a proximal end portion, a distal end portion, and a medial portion, the medial portion having an external surface spaced radially inward from the axial bore of the module body to form an annular cavity therebetween to contain electronic circuitry, the proximal and the distal end portions of the central core each have diameters greater than a diameter of the medial portion of the central core;

wherein the central core includes a cylindrical cover extending around the medial body portion of the central core, at least a portion of an exterior surface of the proximal end portion of the central core, and at least a portion of an exterior surface of the distal end portion of the central core, the cylindrical cover positioned within the axial bore of the module body and having an inner surface spaced radially apart from the exterior surface of the medial portion of the central core.

28. The subsea control module as defined in claim 27, further comprising:

a plurality of containers positioned to contain distributed electrical component defining a plurality of pilot valve modules each including a pilot valve housing, each pilot valve housing containing a plurality of pilot valves, a plurality of pressure transducers, a plurality of solenoids, and electronic circuitry.

29. The subsea control module as defined in claim 28, wherein each pilot valve housing contains a dry, air-tight cavity, purged of air and containing nitrogen at a pressure of at or near approximately atmospheric pressure.

30. The subsea control module as defined in claim 28, wherein each pilot valve housing is characterized by being a fluid filled cavity and pressure compensated.

31. The subsea control module as defined in claim 28, wherein the proximal body end portion of the module body includes a plurality of passageways formed in the proximal body end portion and collectively positioned to communicate hydraulic fluid with the plurality of pilot valve modules; and wherein the proximal end portion of the central core includes a plurality of passageways formed in the proximal portion, each containing an electrical penetrator positioned to communicate power and control signals between the electronic control module and at least a separate one of the plurality of pilot valve modules.

32. A subsea control module to connect to a piece of subsea equipment, comprising:

a subsea control module body having an axial bore extending therethrough, the module body includes a proximal body end portion, a distal body end portion, and a medial body portion extending therebetween, the medial body portion of the module body including an elongate annular recess extending radially into the medial body portion to define a valve module receptacle;

a plurality of directional control valve modules each replaceably positioned within the valve module receptacle, each control valve module positioned radially along an inner surface of the valve module receptacle and adapted to communicate hydraulic fluid with a separate one of a plurality of spaced apart apertures in the medial body portion of the module body, each control valve module including a valve module housing containing one or more directional control valves oriented axially within the respective valve module housing along a same longitudinal axis to thereby reduce a lateral physical signature of the respective valve housing;

a plurality of detachable containers positioned to contain distributed electrical components defining a plurality of pilot valve modules each including a pilot valve housing, each pilot valve housing containing a plurality of pilot valves, a plurality of pressure transducers, a plurality of solenoids, and electronic circuitry.

33. The subsea control module as defined in claim 32, further comprising:

a central core positioned within the axial bore of the module body and including a proximal end portion, a distal end portion, and a medial portion, the medial portion having an external surface spaced radially inward from the axial bore of the module body to form an annular cavity therebetween to contain electronic circuitry, the proximal and the distal end portions of the central core each have diameters greater than a diameter of the medial portion of the central core;

wherein the central core includes a cylindrical cover extending around the medial body portion of the central core, at least a portion of an exterior surface of the proximal end portion of the central core, and at least a portion of an exterior surface of the distal end portion of the central core, the cylindrical cover positioned within the axial bore of the module body and having an inner surface spaced radially apart from the exterior surface of the medial portion of the central core; and wherein the electronic circuitry contained within the annular cavity includes an electronic control module positioned to communicate with each of the plurality of pilot valve modules.

34. The subsea control module as defined in claim 33, wherein the proximal body end portion of the module body includes a plurality of passageways formed in the proximal body end portion and collectively positioned to communicate hydraulic fluid with the plurality of pilot valve modules; and wherein the subsea control module further comprises a seal plate positioned between each of the plurality of pilot valve modules and the plurality of mating passageways to seal an interface between the plurality of pilot valve modules and a plurality of mating passageways; and wherein the proximal end portion of the central core includes a plurality of passageways formed in the proximal end portion, each containing an electrical penetrator positioned to communicate power and control signals between the electronic control module and a separate one of the plurality of pilot valve modules.

35. The subsea control module as defined in claim 33, wherein the annular cavity is characterized by being a dry, air-tight cavity, purged of air and containing nitrogen at a pressure of at or near approximately atmospheric pressure;

wherein each pilot valve housing contains a dry, air-tight cavity, purged of air and containing nitrogen at a pressure of at or near approximately atmospheric pressure.

36. The subsea control module as defined in claim 33, wherein the annular cavity is characterized by being a fluid filled cavity and pressure compensated; and wherein each pilot valve housing is characterized by being a fluid filled cavity and pressure compensated.

37. The subsea control module as defined in claim 32, further comprising:

a plurality of couplings extending distally from the distal body end portion of the module body; and a cylindrical outer cover extending around an exterior of the medial body portion of the module body and around an exterior of the distal body end portion of the module body, and extending axially beyond a distal end surface of the distal body end portion of the module body to provide damage protection to the plurality of couplings when coupling the subsea control module to a subsea equipment receptacle.

* * * * *